US008976212B2

(12) United States Patent
Watson et al.

(10) Patent No.: US 8,976,212 B2
(45) Date of Patent: Mar. 10, 2015

(54) PRINTHEAD ADJUSTMENT MECHANISM FOR EDGE JUSTIFIED PRINTER

(75) Inventors: Jan Watson, Miamisburg, OH (US); Thomas P. Keller, Mesa, AZ (US)

(73) Assignee: Avery Dennison Corporation, Glendale, CA (US)

( * ) Notice: Subject to any disclaimer, the term of this patent is extended or adjusted under 35 U.S.C. 154(b) by 0 days.

(21) Appl. No.: 13/196,604

(22) Filed: Aug. 2, 2011

(65) Prior Publication Data

US 2012/0026268 A1 Feb. 2, 2012

Related U.S. Application Data

(60) Provisional application No. 61/370,050, filed on Aug. 2, 2010.

(51) Int. Cl.

| | |
|---|---|
| ***B41J 25/304*** | (2006.01) |
| ***B41J 2/32*** | (2006.01) |
| ***B41J 15/04*** | (2006.01) |
| *B41J 25/312* | (2006.01) |

(52) U.S. Cl.

CPC . *B41J 2/32* (2013.01); *B41J 25/312* (2013.01); *B41J 25/304* (2013.01); *B41J 15/042* (2013.01)

USPC ..... 347/197

(58) Field of Classification Search

USPC ..... 347/197; 400/120.16

See application file for complete search history.

(56) References Cited

U.S. PATENT DOCUMENTS

| | | | | |
|---|---|---|---|---|
| 4,855,755 | A * | 8/1989 | Aizawa | 347/197 |
| 4,912,483 | A * | 3/1990 | Aizawa | 347/197 |
| 5,114,251 | A * | 5/1992 | Mahoney | 400/120.16 |
| 5,304,007 | A * | 4/1994 | Flanagan | 400/120.16 |
| 5,366,302 | A * | 11/1994 | Masumura et al. | 400/120.16 |
| 5,947,618 | A | 9/1999 | Keller et al. | |
| 6,061,076 | A * | 5/2000 | Ishii et al. | 347/197 |
| 6,480,216 | B2 * | 11/2002 | Ando | 347/197 |
| 6,538,680 | B2 * | 3/2003 | Sato | 347/197 |

* cited by examiner

*Primary Examiner* — Huan Tran

(74) *Attorney, Agent, or Firm* — Avery Dennison Retail Information Services LLC

(57) ABSTRACT

The present invention discloses a printer, specifically an edge justified printer, having a housing. The printer further comprises a mounting assembly that holds printable media and a printhead assembly. The printhead assembly of the present invention has a printhead cantilevered to a mounting member by a bracket. The printer further comprises a plurality of adjusting devices wherein each of the adjustive devices includes an adjusting member. The adjusting member(s) allows for pressure to be applied at the end or edge of the printhead and less pressure at the other end or edge of the printhead.

12 Claims, 5 Drawing Sheets

PRINTHEAD ADJUSTMENT MECHANISM FOR EDGE JUSTIFIED PRINTER

CROSS-REFERENCE TO RELATED APPLICATION

The present application claims the benefit of U.S. Provisional Application No. 61/370,050 filed Aug. 2, 2010, which is incorporated herein by reference in its entirety.

FIELD OF THE INVENTION

The present inventive subject matter relates generally to the art of printers. Particular relevance is found in connection with edge justified thermal printers, and accordingly the present specification makes specific reference thereto. However, it is to be appreciated that aspects of the present inventive subject matter are also equally amenable to other like applications.

BACKGROUND OF THE INVENTION

One example of a known thermal printer is disclosed in U.S. Pat. No. 5,947,618 to Keller, et al., is incorporated by reference herein in its entirety. The aforementioned printer is a center justified printer—meaning that label stock or other like print media is centered with respect to a printhead which is used to mark the media. Other printers are known as edge justified printers—meaning that the label stock or other like print media is located to one side or edge of the printhead.

In general, the print media is routed or passed between a platen roller and the printhead which marks the media. Achieving good print quality and/or proper printer operation is at least partially dependent upon having an appropriate pressure applied to the printhead so that suitable contact is made with the print media. Conversely, applying excessive pressure to the printhead can cause the printhead to abut the media and/or platen roller with too much force thereby resulting in poor print quality or poor printer operation and/or undue wear on the printhead.

In the case of a center justified printer, it is generally acceptable to have a pressure applied to the printhead which is substantially uniform across its width. However, for an edge justified printer, it is often desirable to have a pressure applied to the printhead which is non-uniform across its width, e.g., depending on the width of the media being used at the time. For example, when a media is being used which has a relatively narrow width as compared to the width of the printhead, it may be desirable to have one pressure applied at the end or edge of the printhead to which the media is justified (e.g., an inboard end of the printhead) and relatively less pressure applied at the other end or edge of the printhead (e.g., an outboard end of the printhead).

Accordingly, a new and/or improved printhead adjustment mechanism for edge justified printers is disclosed which addresses the above-referenced problem(s) and/or others.

BRIEF SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

The present invention provides a printer having a housing, a mounting assembly that holds printable media and a printhead assembly. The printhead assembly of the present invention may be cantilevered to a mounting member of the printer via a bracket. The printhead assembly is mounted to the mounting member via a bracket. The printer may further comprise pair of pressure adjusting devices wherein each adjusting device includes an adjusting member that is received in the bracket.

The present invention also provides an adjusting member having a body that may be cylindrical wherein the body has at least one opening or slot. The adjusting member further comprises an outer member having a plurality of longitudinal extensions.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

These, as well as other objects and advantages of this invention, will be more completely understood and appreciated by referring to the following more detailed description of the presently preferred exemplary embodiments of the invention in conjunction with the accompanying drawings, of which.

DETAILED DESCRIPTION OF THE INVENTION

The apparatuses and methods disclosed in this document are described in detail by way of examples and with reference to the figures. Unless otherwise specified, like numbers in the figures indicate references to the same, similar, or corresponding elements throughout the figures. It will be appreciated that modifications to disclosed and described examples, arrangements, configurations, components, elements, apparatuses, methods, materials, etc. can be made and may be desired for a specific application. In this disclosure, any identification of specific shapes, materials, techniques, arrangements, etc. are either related to a specific example presented or are merely a general description of such a shape, material, technique, arrangement, etc. Identifications of specific details or examples are not intended to be, and should not be, construed as mandatory or limiting unless specifically designated as such. Selected examples of apparatuses and methods are hereinafter disclosed and described in detail with reference made to FIGURES.

For clarity and simplicity, the present specification shall refer to structural and/or functional elements, relevant standards and/or protocols, and other components that are commonly known in the art without further detailed explanation as to their configuration or operation except to the extent they have been modified or altered in accordance with and/or to accommodate the preferred embodiment(s) presented herein.

Figure 1:
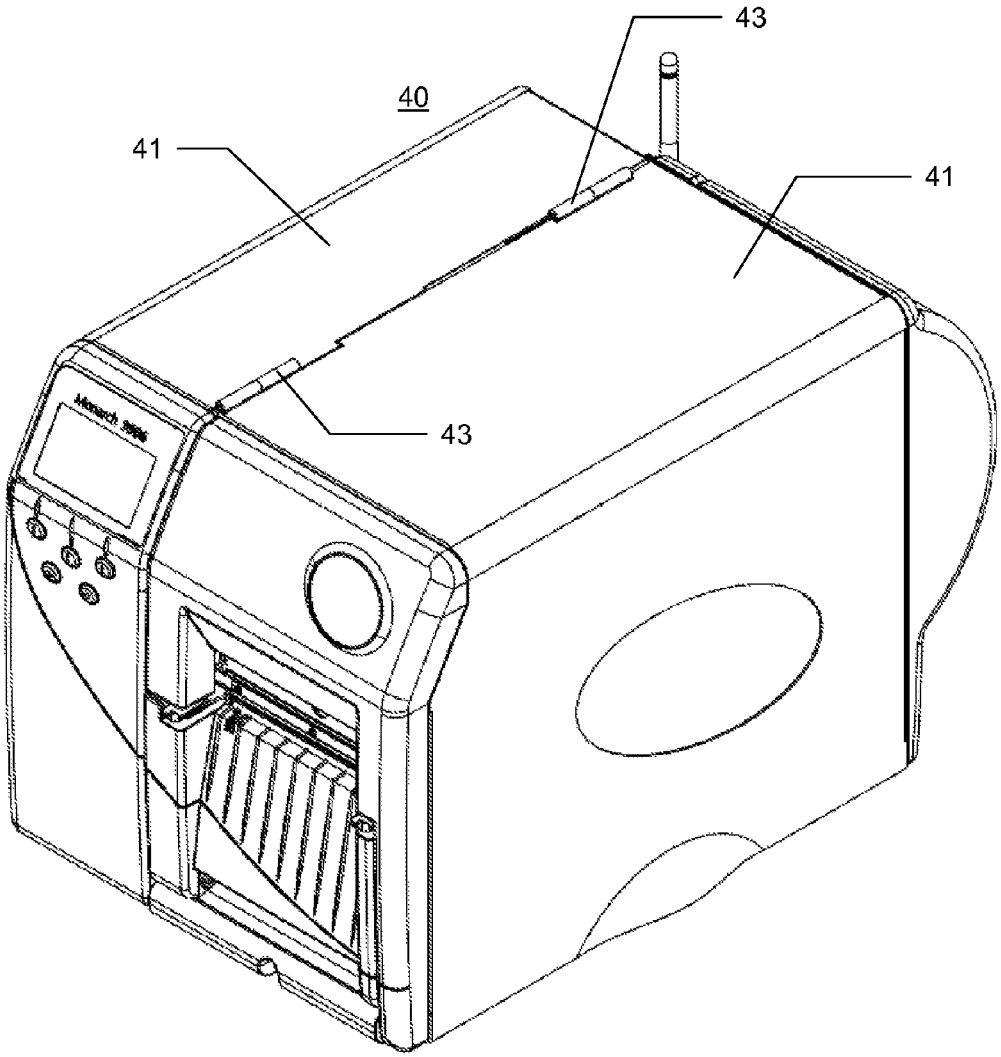
FIG. 1 is a diagrammatic illustration of an edge justified thermal printer in accordance with aspects of the present inventive subject matter.
Figure 2:
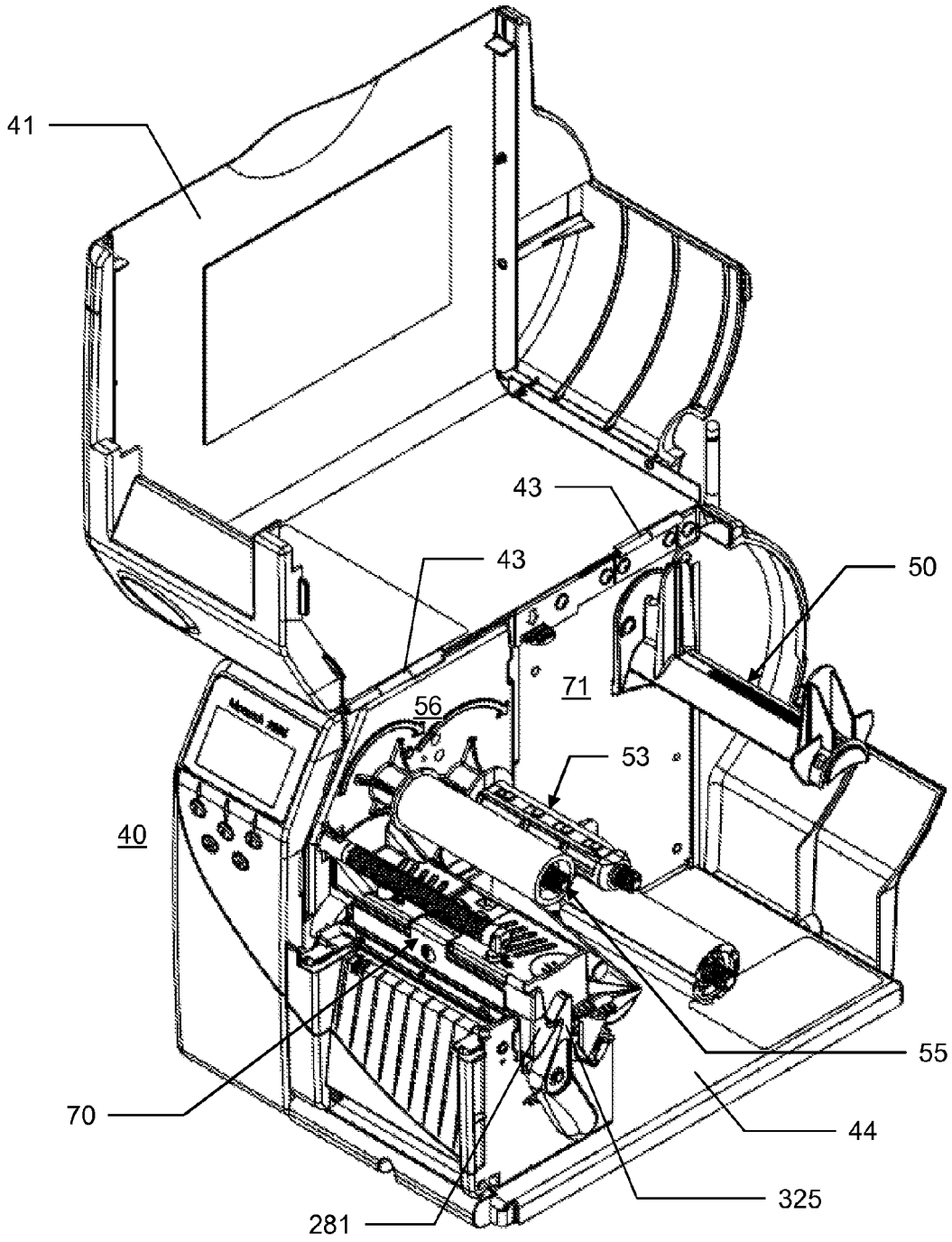
FIG. 2 shows the printer of FIG. 1 having an outer housing opened to reveal internal components of the printer, including a printhead assembly mounted in cantilevered fashion to a mounting member.

With reference now to FIGS. 1 and 2, there is shown an edge justified thermal printer generally indicated at 40 having a two piece housing 41 pivotally joined together at hinges 43. The housing 41 in one embodiment has more than two pieces. The printer 40 also includes a frame 44 to which the housing 41 is mounted. A roll of label stock or other suitable print media (not shown) is held by the media supply roll mounting assembly 50 mounted on a vertical wall 71 of the frame 44. For example, the label stock may include a series of individual labels or record members releasably adhered via a pressure sensitive adhesive or the like to a release liner or similar continuous web of material. In any event, the print media is supplied from the roll held by the media supply roll mounting assembly 50 to a thermal printhead 69 (see FIG. 3) for marking thereby. Suitably, the media supply roll mounting assembly 50 provides the print media, or the media is otherwise routed to the printhead 69, in an edge justified manner, i.e., so that the print media aligns with and/or along one of two opposite ends or edges of the printhead 69. For example, in the illustrated embodiment, the media aligns with or along the left or inboard end or edge 69' of the printhead 69.

Figure 6:
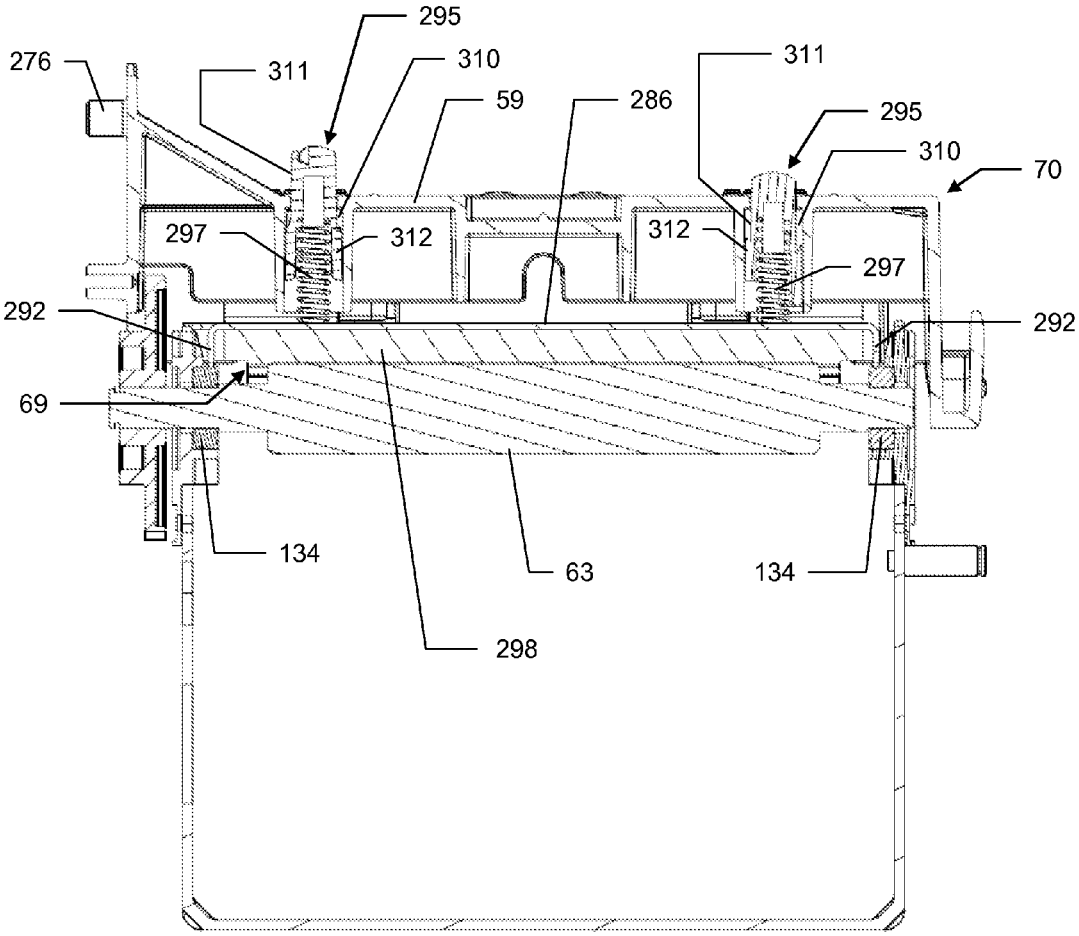
FIG. 6 is a diagrammatic illustration showing a cross-section view of the printhead assembly illustrated in FIG. 3 relative to an underlying platen roller.

FIG. 2 also shows: an ink ribbon supply spindle 53 for holding a roll of thermal ink ribbon (not shown) from which the ribbon is supplied to the printhead 69; and, an ink ribbon take-up spindle 55 for receiving and holding a roll of the spent or used ink ribbon. FIG. 2 further shows a selectively pivotable mounting member 56 to which the spindles 53 and 55 are mounted in a cantilevered fashion. Further, a printhead assembly 70 containing the printhead 69 is also mounted in a cantilevered fashion to the mounting member 56. As shown, the selectively pivotable mounting member 56 is positioned upright or vertically, i.e., in the operating position. To facilitate loading and/or threading of the print media and/or ink ribbon between the printhead 69 and a cooperating platen roller 63 (see FIG. 6), the mounting member 56 is selectively tilted back from the upright position thereby raising the cantilevered printhead assembly 70 away from the platen roller 63.

As can be appreciated, suitably the print media is routed and/or guided along a path from the roll carried by the media supply roll mounting assembly 50 to the printhead assembly 70 where it passes (along with an optional ink ribbon from the ink ribbon supply spindle 53) between the thermal printhead 69 of the printhead assembly 70 and the cooperating platen roller 63.

Figure 3:
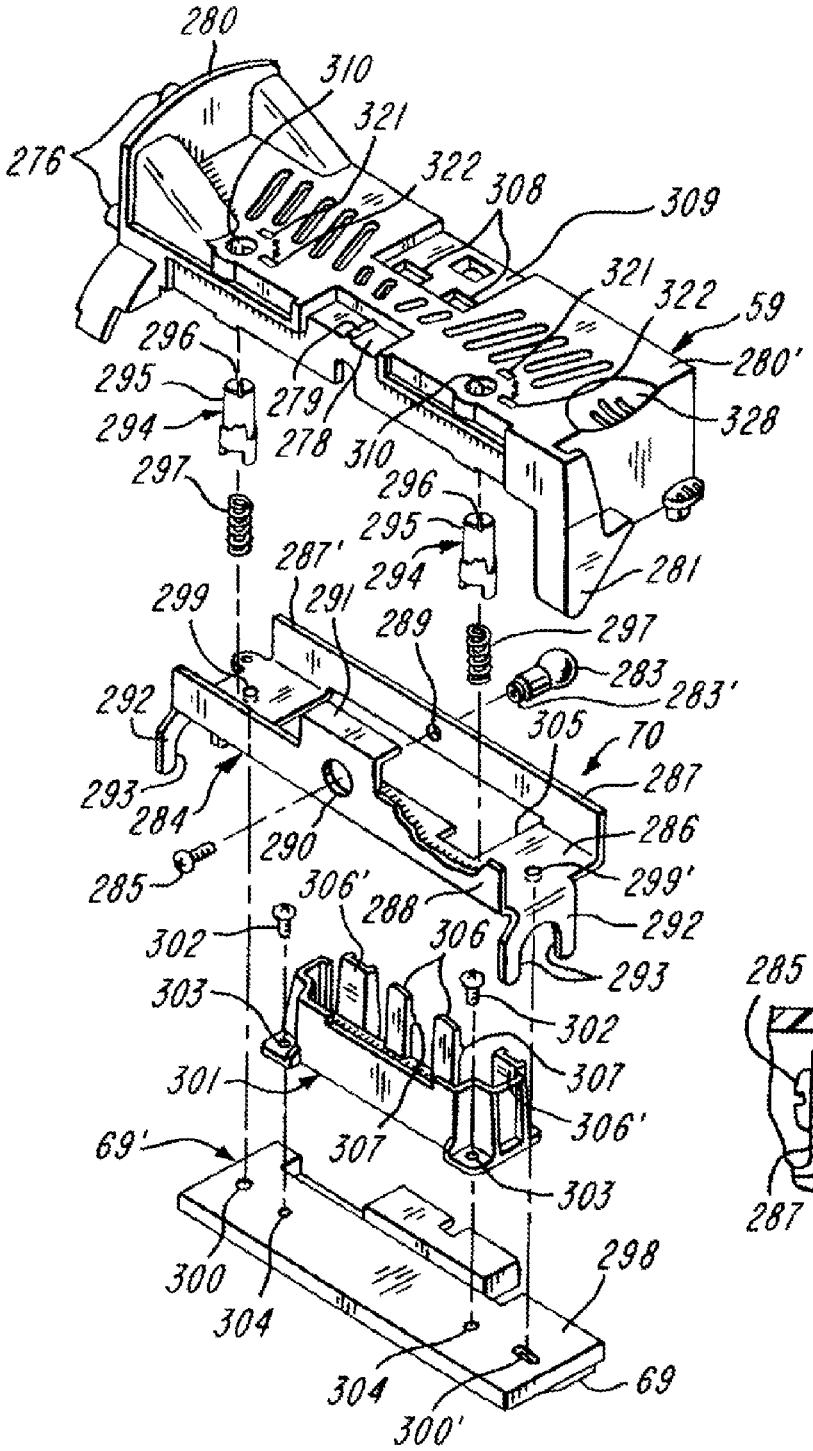
FIG. 3 is a diagrammatic illustration showing an exploded view of the printhead assembly illustrated in FIG. 2.
Figure 4:
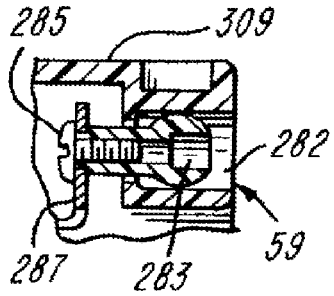
FIG. 4 is a diagrammatic illustration showing a partial fragmentary view of the printhead assembly illustrated in FIG. 3.

With reference now to FIGS. 3 through 6, the printhead assembly 70 is mounted via a printhead housing or bracket 59 to the mounting member 56 in cantilevered fashion. The bracket 59 has a plurality of spaced studs 276 which are snugly received in holes or mated recesses (not shown) in the mounting member 56. The present invention contemplates that more than one bracket may be used to secure the printhead assembly 70 to the mounting member. The bracket 59 has a recess 278 with a rounded projection or pivot edge 279 disposed in the recess 278. The recess 278 is disposed approximately midway along the width of the bracket 59. The free end portion 280' of the bracket 59, which is opposite to end portion 280, has a latch member 281 which cooperates with a latch member 325 (see FIG. 2) to selectively hold the printhead assembly 70 and the mounting member 56 in the closed or operating position. With particular reference to FIG. 4, the bracket 59 has a socket 282 in lateral alignment with the laterally extending projection 279. The socket 282 receives a ball-shaped member 283 which is secured to a metal mounting member 284 by a screw 285. The mounting member 284 is generally U-shaped in construction and has a bight 286 and upstanding vertical walls 287 and 288. The wall 287 has a hole 289 through which a pilot boss 283' of ball-shaped member 283 extends. The wall 288 has a hole 290 laterally aligned with the hole 289 through which a screw driver can be inserted to tighten or loosen the screw 285. The wall 288 has a bent over tab or flange 291 received in the recess 278. The underside of the flange 291 contacts the projection 279. The mounting member 284 is capable of rocking or canting in a vertical plane about the projection 279 where contact is made with the flange 291 and about the place where the socket or pocket 282 receives the ball-shaped member 283. The mounting member 284 can also adjust in a horizontal plane as the mounting member 56 is moved from its open position to the closed position. In particular, the mounting member 284 has a pair of depending forked locating members 292 each of which has parallel guide walls 293 for receiving and locating on bearings 134 (see FIG. 6) which rotatably support the platen roller 63. In this way the mounting member 284 and, indeed, the printhead 69 are accurately located in or near parallel with respect to the axis of the platen roller 63.

A pair of pressure adjusting devices 294 are used to adjust the forces exerted and/or pressure applied from the bracket 59 against the mounting member 284 and in turn which the printhead 69 exerts against the print media and/or the platen roller 63. In one embodiment a single adjusting device may be utilized 297. In another embodiment a plurality of adjusting devices 294 are utilized. The adjusting devices 294 each include a dial or adjusting member 295 having a slot 296 and a spring 297 which bears against the upper surface of the bight portion 286. The projection 279 and the ball-shaped member 283 are preferably located midway between the places where the springs 297 contact the bight portion 286.

The printhead 69 is mounted on the underside of a printhead support plate 298. The support plate 298 further comprises an upperside (not shown). The plate 298 is preferably constructed of metal such as aluminum and acts as a heat sink. The bight portion 286 has integrally formed depending projections or dimples 299 and 299' received in holes 300 and 300' in the plate 298. The hole 300' is an elongate slot which extends widthwise of the plate 298. A connector 301 is secured to the plate 298 by screws 302 passing through holes 303 and threadably received in holes 304 in the plate 298. The connector 301 is received in a hole or opening 305 in the bight portion 286. The connector 301 has a perimeter having a plurality of openings around the perimeter and is flexible, resilient, manually deflectable, upstanding spring fingers 306 with projections 307. The spring fingers 306 extend through the hole 305. The projections 307 rest on upper edge 287' of the wall 287 and upper portions of the spring fingers 306, extend through holes 308 located in a recess 309 in the upper surface of the bracket 59. The spring fingers 306 are manually engageable and when moved to the left or forward as seen in FIG. 3, the projections 307 release from the edge 287'. Upstanding rigid fingers 306' fit against the outside of the flange or wall 287. Thus, the wall 287 is straddled by the two spring fingers 306 and by the two rigid fingers 306'. As is apparent there is a snap-fit connection to hold the printhead 69, the plate 298 and the connector 301 to the mounting member 284. The connector 301 tapers slightly inwardly and upwardly as viewed in FIG. 3 which allows the connector 301 to be easily inserted into the opening 305. When the connector 301 is fully inserted into the opening 305, the connector 301 makes a snug fit with the side edges of the opening 305. Thus, it is readily apparent that the printhead 69, the plate 298, the connector 301 and the mounting member 284 move as a unit on the support 59. The locating members 292 are guided into place on the bearing 134 as the printhead assembly 70 is moved into its closed or operating position. The aforementioned unit can then gimbal in the horizontal and vertical planes with respect to the support 59. The bracket 248 and the connector 301 in their assembled condition, are held to the bracket 59 against the forces of the springs 297 by the flange 291 and the ball shaped member 283. However, when the printhead assembly 70 is brought into the closed or operating position and the forked members 292 are guided by the bearings 134, the springs 297 compress and the printhead 69 substantially aligns with the axis of the platen roller 63.

Figure 5:
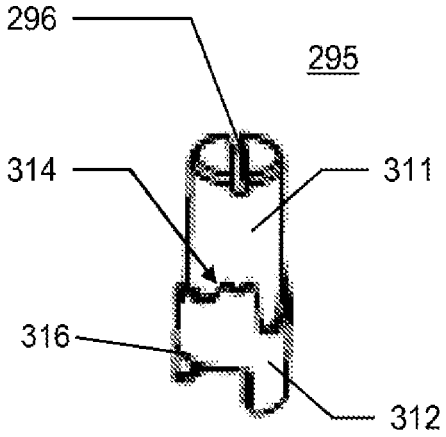
FIG. 5 is a diagrammatic illustration showing an enlarged view of the dial or adjustment member illustrated in FIG. 3.

As illustrated in FIG. 5, each adjusting member 295 is received in an axial bore 310 in the bracket 59. The adjusting member 295 has a cored out axially extending, right-circular cylindrical body 311 and an outer annular ring or member 312 with a pair of diametrically opposed depending arcuate members, also referred to as a plurality of longitudinal extension 316. The members 312 receive a portion of the length of the springs 297. Each spring 297 abuts a lower edge of the respective body 311 within the cored out cylinder. Upper outside ridges or shelves of the members 312 act as cam surfaces 314. For example, the cam surfaces 314 may define different level settings which progressively increase or decrease in height around the circumference of the body 311. Suitably, at each preset level, the cam surface 314 may include a depression or recess for holding or retaining a cam follower therein. Suitably, each cam surface 314 may include two or more different preset levels. In one embodiment, each cam surface includes at least four different preset levels.

Suitably, each bore 310 has at least one inwardly projecting cam follower (not shown) which rides on and/or otherwise cooperates with the corresponding cam surfaces 314. Optionally, each bore may include a pair of such cam followers which are located on diametrically opposed sides of the bore 310 and each cam surface 314 may be duplicated on diametrically opposed sides of the dial or adjusting member 295. For example, the cam followers may be integrally formed with the bracket 59 on the inside surface of each bore 310. Accordingly, each dial or adjusting member 295 is selectively located in the bore 310 at one of a plurality of different preset depths depending on the rotational position of the member 295 and hence the location at which the cam followers abut their corresponding cam surfaces 314.

Depending on the depth at which each member 295 is located in its respective bore 310, the corresponding spring 297 may be compressed more or less between the body 311 of each adjusting member 295 and the upper surface of the bight 286, and hence, more or less pressure respectively may be applied to the corresponding end of the printhead 69. For example, in one position (as shown by the outboard or right adjusting member 295 in FIG. 6), the adjusting member 295 is located relatively deeper in the bore 310, thereby causing the underlying spring 297 to exert a higher force against the bight portion 286 and according a higher pressure is applied to the corresponding end of the printhead 69. Conversely, in another position (as shown by the left or inboard adjusting member 295 in FIG. 6), the adjusting member 295 is located relatively higher in the bore 310, thereby causing the underlying spring 297 to exert a lower force against the bight portion 286 and accordingly a lower pressure is applied to the corresponding end of the printhead 69.

Suitably, adjustments are selectively made by inserting a coin or a screw driver in the slot 296 to turn the corresponding dial or adjusting member 295 to the desired preset level. By rotating the members 295 until the corresponding cam followers abut or rest on a given preset level of the cam surfaces 314, as the case may be, the spring force adjustments are made. In this manner, adjustments can be selectively made to accommodate print media of different thicknesses and/or widths. For wider print media, for example, four inches in width or sufficiently close to the full width of the printhead 69, relatively higher force is generally desired and thus the members 295 may be set relatively deeper in the bores 310. For narrower print media, for example, two inches in width or sufficiently less than the width of the printhead 69, relatively lower force is generally desire and thus the members 295 may be set relatively higher in the bores 310.

As seen, the adjusting devices 294 are individually adjustable and there are a plurality of registration marks (e.g., such as marks 321 and 322) on the bracket 59 around the bores 310 to show at which preset level each adjusting device 294 is set. During use of the printer 40, depending on the width of the print media, suitably the adjusting members 295 are set so that the springs 297 will exert unequal spring forces against the bight portion 286 and hence uneven pressure will be applied across the width of the printhead 69. Alternately, again depending on the width of the print media, the adjusting members 295 may be set so that the springs 297 will exert substantially equal spring forces against the bight portion 286 and hence even pressure will be applied across the width of the printhead 69.

For example, assuming that the print media is justified or aligned under the left end or inboard edge of the printhead 69, when using a narrower width print media (e.g., two inches or sufficiently less than the width of the printhead 69), suitably the spring force exerted by the right or outboard adjusting device 294 is set relatively lower than the spring force exerted by the left or inboard adjusting device 294, and hence, the pressure applied to the right or outboard end of the printhead 69 is relatively lower than the pressure applied to the left or inboard end of the printhead 69. Alternately, assuming again that the print media is still justified or aligned under the left end or inboard edge of the printerhead 69, when using a wider width print media (e.g., four inches or sufficiently close to the full width of the printhead 69), suitably the spring force exerted by the right or outboard adjusting device 294 is set substantially equal to the spring force exerted by the left or inboard adjusting device 294, and hence, the pressure applied to the right or outboard end of the printhead 69 is substantially equal to the pressure applied to the left or inboard end of the printhead 69.

In one suitable embodiment, each cam surface 314 is substantially continuous around the circumference of the cylindrical body 311 and the dial or adjusting member 295 is free to rotate 360 degrees or greater within the bore 310. While rotating the dial or member 295, to help eliminate or alleviate resistance which would otherwise be experienced due to the cam follower meeting a steep or substantially vertical incline on the cam surface 314, a user may optionally apply a downward force on the dial or member 295 to overcome the back pressure of the underlying spring 297 and hence permit the cam follower to more easily ride or pass over the incline.

In any event, it is to be appreciated that in connection with the particular exemplary embodiment(s) presented herein certain structural and/or function features are described as being incorporated in defined elements and/or components.

However, it is contemplated that these features may, to the same or similar benefit, also likewise be incorporated in other elements and/or components where appropriate. It is also to be appreciated that different aspects of the exemplary embodiments may be selectively employed as appropriate to achieve other alternate embodiments suited for desired applications, the other alternate embodiments thereby realizing the respective advantages of the aspects incorporated therein.

It is also to be appreciated that certain elements described herein as incorporated together may under suitable circumstances be stand-alone elements or otherwise divided. Similarly, a plurality of particular functions described as being carried out by one particular element may be carried out by a plurality of distinct elements acting independently to carry out individual functions, or certain individual functions may be split-up and carried out by a plurality of distinct elements acting in concert. Alternately, some elements or components otherwise described and/or shown herein as distinct from one another may be physically or functionally combined where appropriate.

In short, the present specification has been set forth with reference to preferred embodiments. Obviously, modifications and alterations will occur to others upon reading and understanding the present specification. It is intended that the invention be construed as including all such modifications and alterations insofar as they come within the scope of the appended claims or the equivalents thereof.

It will thus be seen according to the present invention a highly advantageous. adjustment mechanism for an adjustment mechanism has been provided. While the invention has been described in connection with what is presently considered to be the most practical and preferred embodiment, it will be apparent to those of ordinary skill in the art that the invention is not to be limited to the disclosed embodiment, and that many modifications and equivalent arrangements may be made thereof within the scope of the invention, which scope is to be accorded the broadest interpretation of the appended claims so as to encompass all equivalent structures and products.

The inventors hereby state their intent to rely on the Doctrine of Equivalents to determine and assess the reasonably fair scope of their invention as it pertains to any apparatus, system, method or article not materially departing from but outside the literal scope of the invention as set out in the following claims.

What is claimed is:

1. An edge justified printer comprising:

a housing having at least two sections mounted on a frame having a wall;

a mounting assembly that holds printable media, the mounting assembly being mounted on the wall of the frame;

a platen roller;

a printhead assembly having a printhead cantilevered to a mounting member by a bracket wherein the printable media is located to be near an edge of the printhead;

at least a pair of adjusting devices such that each adjusting device is individually adjustable, and wherein each adjusting device includes at least one adjusting member;

wherein the bracket comprises an axial bore, and there are a plurality of registration marks on the bracket around the axial bore to display at which preset level the at least one adjusting device is set at; and wherein the at least a pair of adjusting devices is set such that uneven pressure is applied across a width of the printhead.

2. The printer of claim 1, wherein each adjusting member is received in the axial bore.

3. The printer of claim 1, wherein each adjusting member for a printer comprises:

a body having at least one opening;

an outer annular member having a plurality of longitudinal extensions that receives a portion of at least one spring;

wherein a surface of the outer member acts as a cam surface;

wherein each cam includes a plurality of preset levels; and wherein the adjusting member is set so that the at least one spring exerts unequal forces against a bight portion of the printer.

4. The printer of claim 3, wherein the cam surface includes a recess for holding a cam follower.

5. The printer of claim 3, wherein the body is cylindrical and has a circumference.

6. The printer of claim 5, wherein the cam surface is continuous around the circumference of the body.

7. A print head assembly for an edge justified printer comprising:

a bracket including at least one axial bore mounted to a mounting member having a bight portion with an opening;

a support plate having an underside and an upperside wherein a printhead is mounted on the underside of the support plate;

a connector secured to the upperside of the support plate and received in the opening in the bight portion of the mounting member;

at least a pair of adjusting members wherein each adjusting member has an outer annular member and being received in the at least one axial bore of the bracket;

wherein the bracket comprises a plurality of registration marks around the at least one axial bore to display at which preset level the at least one adjusting member is set at;

wherein the adjusting members are set such that uneven pressure is applied across a width of the printhead; and wherein print media is located to be near an edge of the printhead.

8. The print head assembly of claim 7, wherein the connector comprises spring fingers that extend through the opening in the bight portion.

9. The print head assembly of claim 7, wherein the support plate has a first and second set of openings wherein the second set of openings are closer to a perimeter of the support plate than the first set of openings.

10. The print head assembly of claim 9, wherein the connector further comprises a plurality of openings around a perimeter of the connector.

11. The print head assembly of claim 10, wherein the connector is secured to the plate by screws passing through the plurality of openings in the perimeter of the connector and received in the first set of openings in the support plate.

12. The printer of claim 1, wherein the printhead assembly is configured to apply uneven pressure across the width of the printhead.

* * * * *